US005419013A

United States Patent [19]

Hsiao

[11] Patent Number: 5,419,013

[45] Date of Patent: May 30, 1995

[54] HYDRAULIC HINGE HAVING ROTATABLE SHAFT AND LINEARLY MOVABLE PLUG FORMING FLUID CHAMBERS

[76] Inventor: Chun-Sung Hsiao, 4F, No. 2, Alley 3, Lane 297, An Chin Street, Sanchung City, Taipei Hsien, Taiwan, Prov. of China

[21] Appl. No.: 165,657

[22] Filed: Dec. 10, 1993

[51] Int. Cl.[6] ..... E05F 3/04

[52] U.S. Cl. ..... 16/319; 16/54

[58] Field of Search ..... 16/50, 51, 54, 62, 82, 16/83, 297, 319, 337

[56] References Cited

U.S. PATENT DOCUMENTS

| | | | |
|---|---|---|---|
| 4,068,344 | 1/1978 | Okabe | 16/54 |
| 4,756,051 | 7/1988 | Shy | 16/54 |
| 5,109,571 | 5/1992 | Ohsima et al. | 16/54 |
| 5,211,269 | 5/1993 | Ohshima | 16/82 |

FOREIGN PATENT DOCUMENTS

| | | |
|---|---|---|
| 0251972 | 6/1987 | European Pat. Off. . |
| 3822382 | 11/1980 | Germany . |

*Primary Examiner*—Irene Cuda
*Assistant Examiner*—Kenneth J. Hansen
*Attorney, Agent, or Firm*—Ezra Sutton

[57] ABSTRACT

A hydraulic hinge includes a cylinder sealed at both ends having a hexagonal shaft rotatably received therein with a portion thereof extending out of the cylinder. A circumferential space is defined between the shaft and the inside diameter of the cylinder to be filled with hydraulic fluid. A plug having a hexagonal hole corresponding to the cross section of the shaft is fit over the shaft to be rotatable therewith. The plug has an external thread of a desirable pitch to be engageable with an inner thread formed inside the cylinder so that the plug is linearly moved relative to the cylinder and the shaft by the pitch of the external thread thereof when the shaft is rotated. The plug divides the circumferential space into two chambers. A passage is formed in the shaft to form a fluid communication between the two chambers. A spherical member is spring-biased to block the passage, serving as a check valve, so as to allow the hydraulic fluid to flow uni-directionally at a normal flow rate. The spherical member has a passage of reduced cross-section dimension formed therethrough to allow the hydraulic fluid flow between the two chambers at a smaller flow rate. With the different flow rates provided by opening and closing the spherical member, the rotations of the shaft relative to the cylinder along different directions are controlled at different speeds.

9 Claims, 4 Drawing Sheets

HYDRAULIC HINGE HAVING ROTATABLE SHAFT AND LINEARLY MOVABLE PLUG FORMING FLUID CHAMBERS

FIELD OF THE INVENTION

The present invention relates to a hinge structure and in particular to a hydraulic hinge which provides fast opening and slow closing to avoid impact or shock in closing movement.

BACKGROUND OF THE INVENTION

Hinges are used in many devices that have cover or lid to provide relative movement between the lids and the devices. Examples include washing machine and toilet seat and lid. The conventional hinges provide no buffering function to reduce the movement speed of the lid of a device so that the lid is allowed to open and close at substantially the same speed. In opening the lid, it is usually requires fast movement. It is however disadvantageous to close the lid with the same fast speed for this may induce impact or shock on the device itself.

It is therefore desirable to provide a hydraulic hinge to overcome the deficiency of the prior art mechanical hinge used to connect a lid to a device.

SUMMARY OF THE INVENTION

The principal objective of the present invention is to provide a hydraulic hinge which is mounted between a lid and a device to allow the lid to be opened at a fast speed while closed at a slow speed so as to avoid the impact or shock occurring during the closing movement of the lid.

To achieve the above objective, there is provided a hydraulic hinge comprising a cylinder sealed at both ends having a hexagonal shaft rotatably received therein with a portion thereof extending out of the cylinder. A circumferential space is defined between the shaft and the inside diameter of the cylinder to be filled with hydraulic fluid. A plug having a hexagonal hole corresponding to the cross section of the shaft is snugly fit over the shaft to be rotatable therewith. The plug has an external thread of a desirable pitch to be engageable with an inner thread formed inside the cylinder so that the plug is linearly moved relative to the cylinder and the shaft by the pitch of the external thread thereof when the shaft is rotated. The plug divides the circumferential space into two chambers. A passage is formed in the shaft to form a fluid communication between the two chambers. A spherical member is spring-biased to block the passage, serving as a check valve, so as to allow the hydraulic fluid to flow uni-directionally at a normal flow rate. The spherical member has a passage of reduced cross-section dimension formed therethrough to allow the hydraulic fluid flow between the two chambers at a smaller flow rate. With the different flow rates provided by opening and closing the spherical member, the rotations of the shaft relative to the cylinder along different directions are controlled at different speeds.

BRIEF DESCRIPTION OF THE DRAWING

The present invention will be better understood from the following description of a preferred embodiment of the present invention, with reference to the drawings, wherein.

DETAILED DESCRIPTION OF THE PREFERRED EMBODIMENT

Figure 1:
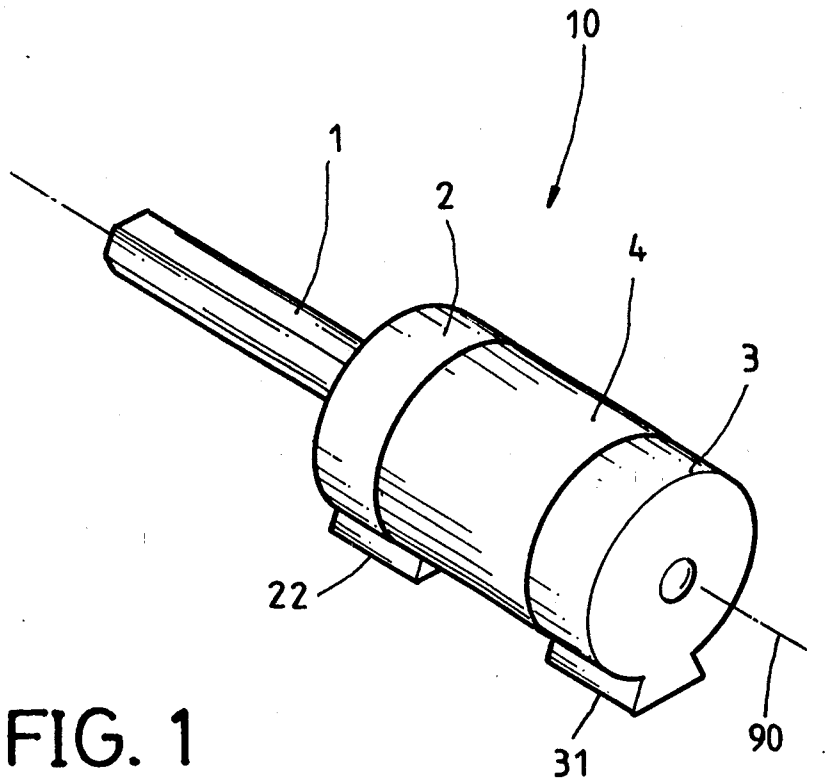
FIG. 1 is a perspective view showing a hydraulic hinge constructed in accordance with the present invention.

With reference to the drawings and in particular FIG. 1, wherein a hydraulic hinge constructed in accordance with the present invention, generally designated with the reference numeral 10, is shown, the hydraulic hinge 10 comprises a cylinder 4 having two opposite open ends into which an elongated shaft 1, preferably having a prismatic cross section and more preferably a hexagon cross section as shown in the drawings, is rotatably inserted. A front cap 2 and a rear cap 3 are respectively mounted to and close the open ends of the cylinder 4 and allowing a portion of the shaft 1 exposed outside the cylinder 4 from the front end thereof.

Figure 3:
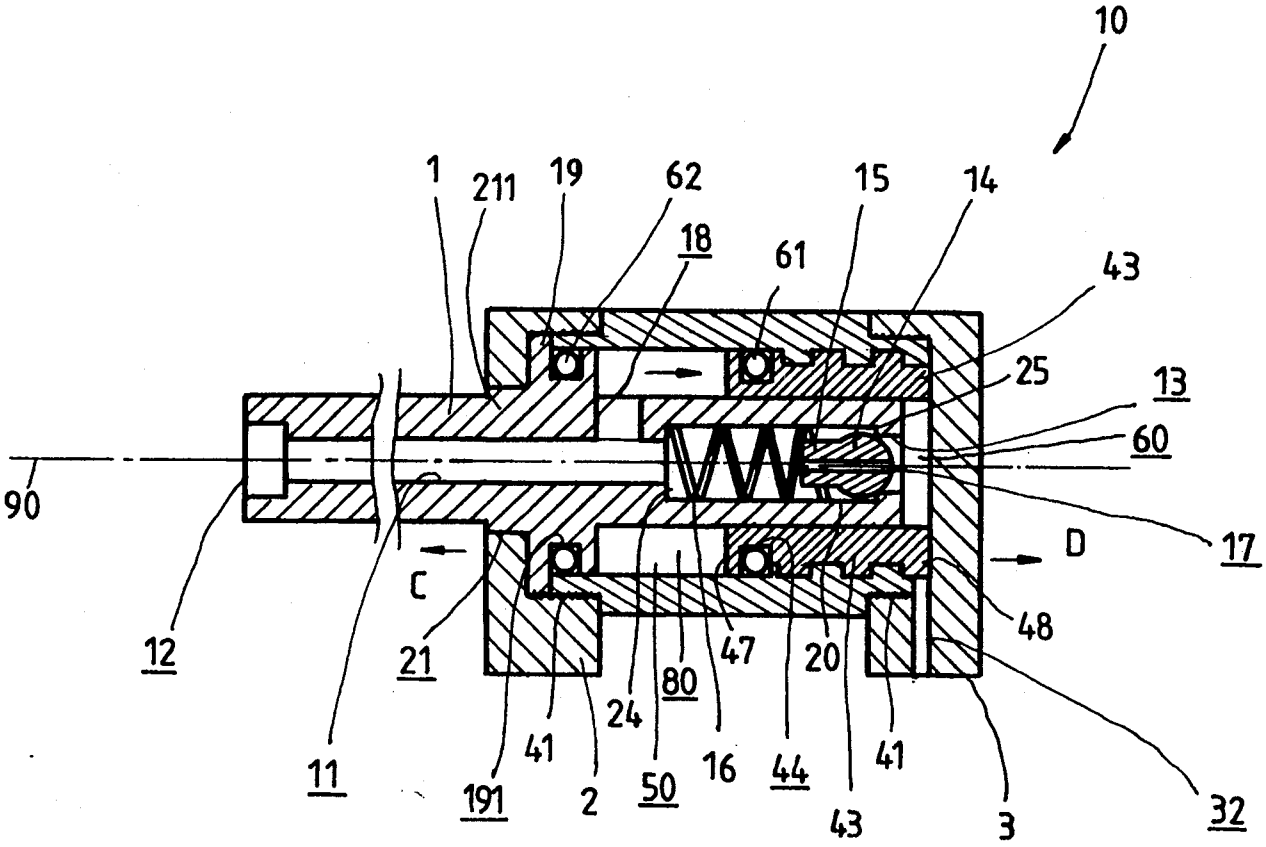
FIG. 3 is a cross-sectional view showing the hydraulic hinge of the present invention.

The terms "front" and "rear" (or "frontward" and "rearward") used herein respectively designate directions relative to the cylinder 4 as viewed best in FIG. 3. In other words, "front" means left and "rear" right in the drawing of FIG. 3. These terms, however, are adapted for easy reference of the description, not to limit the present invention.

Figure 2:
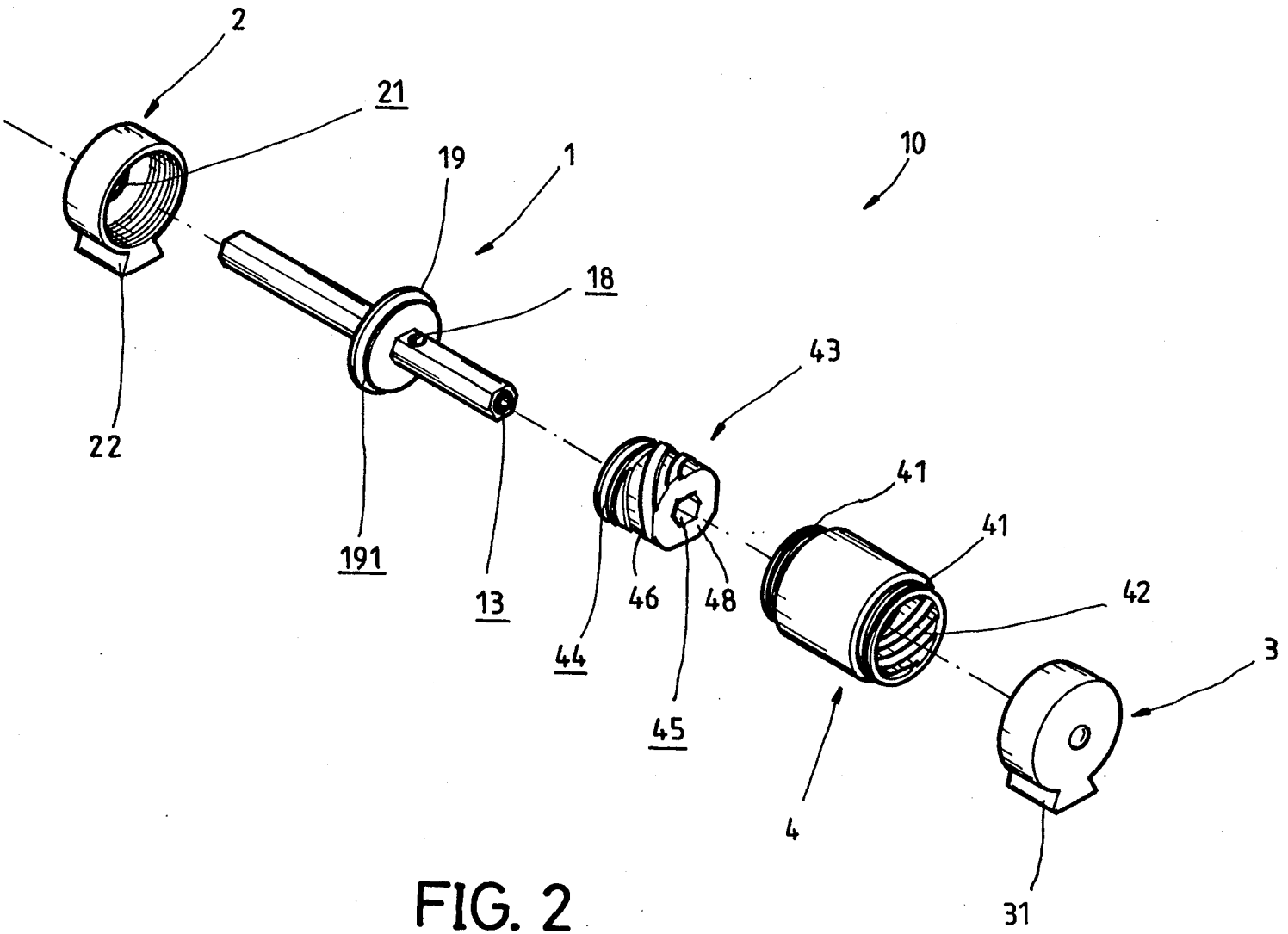
FIG. 2 is an exploded perspective view showing the hydraulic hinge of the present invention.

Further referring to FIGS. 2 and 3 which respectively show an exploded view and a cross-sectional view of the hydraulic hinge 10 of FIG. 1, in the embodiment of the hydraulic hinge 10 illustrated in the drawings, by properly selecting the cross-sectional dimension of the shaft 1 and the inside diameter of the cylinder 4, a circumferential space 80 is formed between the shaft 1 and the inside diameter of the cylinder 4 into which hydraulic fluid is filled.

A plug 43 is linearly movably fit over an end of the shaft 1 by for example having the prismatic shaft 1 inserting into a corresponding multi-angular hole 45 formed on the plug 43 and is snugly received in the circumferential space 80 so as to be rotatable in unison with the shaft 1 about a central axis 90 (FIG. 3) of the cylinder 4. A first fluid chamber 50 is defined in the circumferential space 80 by the shaft 1 and the inside diameter of the cylinder 4 and a front end 47 of the plug 43.

The plug 43 has an externally-threaded portion 46 having a desired pitch to engage an inner-threaded section 42 formed inside the cylinder 4 so as to allow the plug 43 to move relative to the cylinder 4 when the plug 43 is rotated by the shaft 1. As is well known, the linear movement of the plug 43 relative to the cylinder 4 is determined by the pitch of the thread 46 thereof.

The shaft 1 has a central channel 11 (FIG. 3) extending along the length thereof from a front opening 12 to a rear opening 13 thereof. An expanded section 20 is provided on the channel 11 preferably at a location close to the rear opening 13 with a spring-biased spherical blocking member 14 received therein. The expanded section 20 defines a front and a rear circumferential shoulders 24 and 25 with the channel 11. The spring 16 that biases the spherical member 14 has a first end secured to the front shoulder 24 and a second end secured to a cylindrical extension 15 of the spherical member 14 so as to bias the spherical member 14 toward the rear opening 13 to close it by abutting against the rear shoulder 25. This is similar to the structure and function of a generally-known check valve.

The spherical member 14 has a fluid passage 17 of a reduced cross-sectional dimension extending therethrough to provide fluid communication between the rear opening 13 of the channel 11 and the front opening 12. The passage 17 has a cross-sectional dimension much smaller than that of the channel 11 so as to limit the fluid flow rate therethrough.

The shaft 1 further has a radially-extending passage 18, having a cross-sectional dimension similar to that of the channel 11, forming fluid communication between the first chamber 50 and the channel 11.

The circumferential space 80 further provides a second chamber 60 which is formed inside the cylinder 4 and defined by the rear end of the shaft 1, the rear cap 3 and the inside diameter of the cylinder 4 to be in fluid communication with the rear opening 13 of the shaft 1. Although the second chamber 60 is shown isolated from the inside diameter of the cylinder 4 by the plug 43 in FIG. 3, it should be noted that the plug 43 which in FIG. 3 is in its rearmost position as viewed in the drawing and is movable frontward relative to the cylinder 4 and the shaft 1 so that if the plug 43 in FIG. 3 is moved slightly frontward, it can be seen that the second chamber 60 is circumferentially defined by the cylinder 4.

The second chamber 60 is further defined by a rear end 48 of the plug 43, especially when the plug 43 has been moved frontward as explained previously, so as to be separated from the first chamber 50 by the plug 43. However, due to the passage 17 and the radial passage 18, hydraulic fluid is allowed to flow therebetween. In other words, the circumferential space 80 is divided by the plug 43 into the first chamber 50 and the second chamber 60 which are allow to communicate with each other through the reduced passage 17.

Sealing means, such as O-rings 61 and 62, is provided to form hermetical seal of the cylinder 4 at the front and rear end sides thereof. In the embodiment illustrated, the plug 43 has a circumferential slot 44 formed thereon close to the front end thereof to receive therein an O-ring 61 which is in depressed contact with the inside diameter of the cylinder 4 so as to seal the rear end side of the cylinder 4.

Similarly, a front O-ring 62 is provided to seal the front end side of the cylinder 4. To hold the front O-ring 62, the shaft 1 has a disk member 19 mounted thereon at the front end of the cylinder 4. The disk 19 has a circumferential slot 191 to receive therein the front O-ring 62. Preferably, the slot 191 has a side higher than the other side so as to allow the lower side to be received within the cylinder 4 with the front end of the cylinder 4 abutting against the higher side, as shown in FIG. 3. The front O-ring 62 is in depressed contact with the inside diameter of the cylinder 4 so as to hermetically seal the front end of the cylinder 4.

The use and function of the O-rings 61 and 62 are well known to those having ordinary skill so that no further detail will be discussed herein.

Preferably, the front and rear caps 2 and 3 are threadingly secured to the front and rear ends of the cylinder, as shown in the drawings. However, it is understood that other ways, such as welding, can also be used to secure the caps 2 and 3 to the cylinder 4.

The front cap 2 is provided with a central hole 21 to allow the shaft 1 to extend therethrough. Preferably the shaft 1 has a circular section 211 to be rotatably receive within the central hole 21 for supporting the shaft 1.

Figure 4:
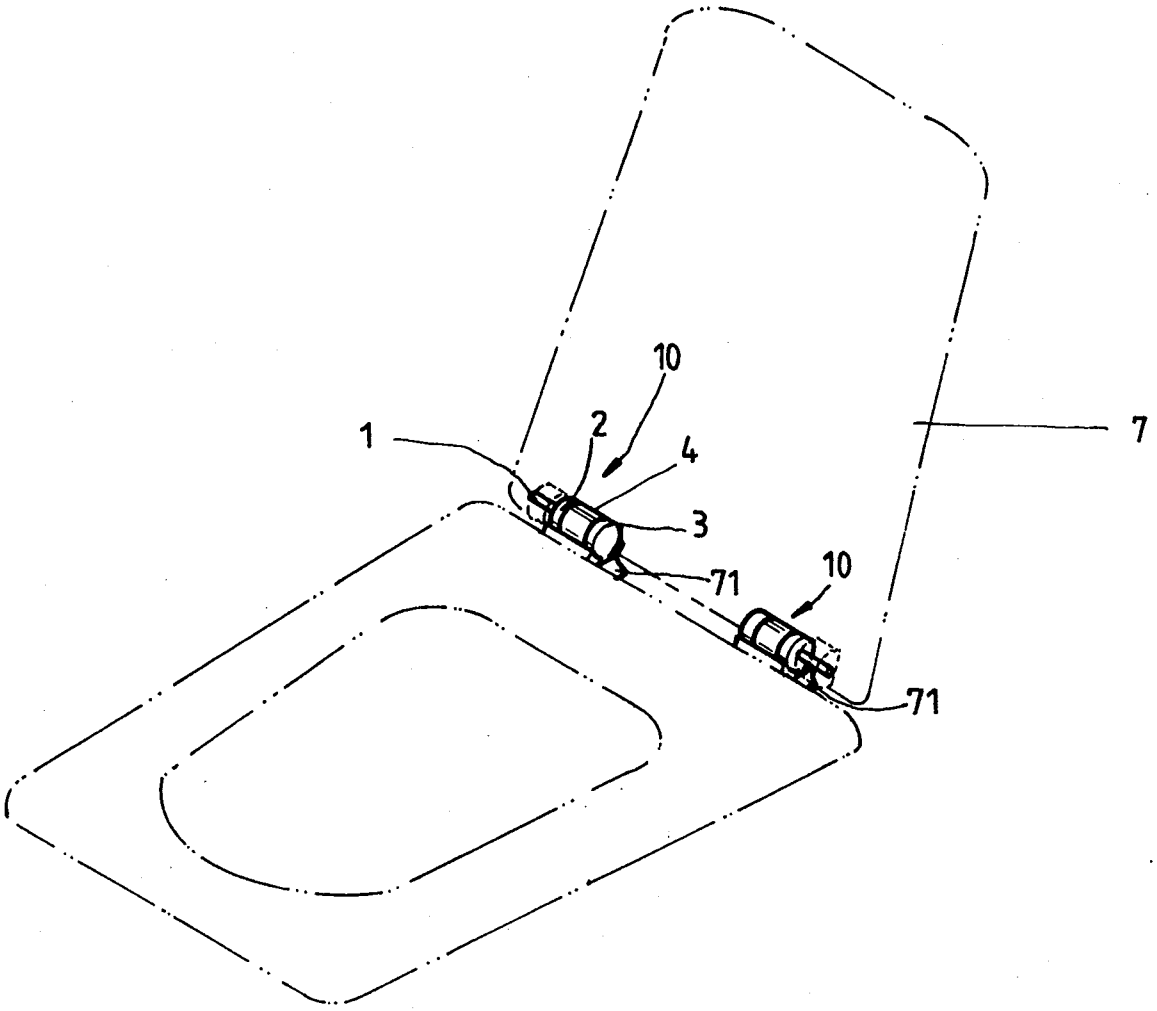
FIG. 4 is a perspective view showing the application of the hydraulic hinge of the present invention on a toilet seat lid.

Preferably, the hydraulic hinge 10 is provided with means for securing to a device that uses the hinge 10. The securing means may comprise portions 22 and 31 of dovetailed cross sections respectively formed on the front and rear caps 2 and 3 so as to allow the hinge 10 to be more securely mounted on the device, such as a toilet seat shown in FIG. 4. In such an application, the front portion of the shaft 1 that is exposed is secured to the toilet seat lid 7 and the dove-tailed portions 22 and 31 of the front and rear caps 2 and 3 are secured to a seat member 71 which is in turn mounted on the toilet bowl (not shown) to provide a relative rotation therebetween under the control of the hydraulic action of the hydraulic hinge 10.

The hydraulic fluid is filled into the cylinder 4 from the front opening 12 of the channel 11 of the shaft 1. In filling the hydraulic fluid into the cylinder 4, the air that may be present inside the cylinder 4 is allow to escape from a passage 32 formed on the rear cap 3 and in communication with the second chamber 60. The air passage 32 may be sealed with any known means, such as screw (not shown) after the cylinder 4 is full of the hydraulic fluid. The front opening 12 of the shaft 1 is similarly sealed after filling the hydraulic fluid.

The operation of the hydraulic hinge 10 of the present invention will now be described.

Without losing generality, take the condition when the toilet seat lid 7 is fully opened (FIG. 4) and is to be closed as an initial situation, by rotating the lid 7 relative to the toilet bowl, the shaft 1 which is secured to the lid 7 is rotated, for example along a first direction, to move the plug 43 by the pitch of the thread 46 thereof frontward, along the direction of arrow C (FIG. 3). This reduces the first chamber 50 and increases the second chamber 60 so that the hydraulic fluid inside the first chamber 50 is forced to flow into the second chamber 60 through the reduced passage 17 formed inside the spherical blocking member 14. Since the passage 17 has such a small cross-sectional dimension, as compared to the channel 11 and the radial passage 18 of the shaft 1, the flow rate of the hydraulic fluid from the first chamber 50 to the second chamber 60 is small. This limits the rotation speed of the lid 7 toward the toilet bowl.

In opening the lid 7, the shaft 1 is rotated along a second direction, opposite to the first direction, so that the plug 43 is moved rearward, along the direction of arrow D shown in FIG. 3. This increases the first chamber 50 and reduces the second chamber 60 and thus increases the pressure inside the second chamber 60 to force the hydraulic fluid to flow from the second chamber 60 to the first chamber 50. The increased pressure of the hydraulic fluid inside the second chamber 60 pushes the spherical blocking member 14 frontward against the spring 16 to open the rear opening 13 so as to allow the hydraulic fluid to flow from the second chamber 60 to the first chamber 50 at a higher flow rate. This allows the lid 7 to be opened in a fast speed.

It is apparent that although the invention has been described in connection with the preferred embodiment, it is contemplated that those skilled in the art may make changes to the preferred embodiment without departing from the spirit and scope of the invention as defined in the appended claims.

What is claimed is:

1. A hydraulic hinge comprising:

a cylinder having an inside diameter defining a front open end and a rear open end respectively sealed by a front cap and a rear cap;

an elongated shaft rotatably inserted into said cylinder from the front open end thereof through a hole formed on said front cap to have a front portion of said shaft extend out of said cylinder;

a circumferential space defined between the inside diameter of said cylinder and said shaft to be filled with a hydraulic fluid;

a plug fit into said circumferential space to divide said circumferential space into a first chamber and a second chamber, said plug being secured to said shaft by securing means in such a way to be rotatable in unison with but linearly movable relative to said shaft and said plug being engageable with the inside diameter of said cylinder by engaging means in such a way to allow said plug to be movable relative to said cylinder so that when said shaft is rotated, said plug rotates therewith and linearly moves relative to said cylinder and said shaft to change sizes of said first and second chambers;

a first fluid passage formed inside said shaft to provide a fluid communication between said first chamber and second chamber, said first fluid passage having such a cross-sectional dimension to allow the hydraulic fluid to flow between said first and second chambers at a first flow rate;

a second fluid passage formed inside said shaft connecting between said first and second chambers, said second fluid passage having checking means mounted therein to prevent the hydraulic fluid from flowing from said first chamber into said second chamber and only allows the hydraulic fluid to flow from said second chamber to said first chamber at a second flow rate greater than said first flow rate; and when said shaft is rotated along a first angular direction, said plug moves inside said circumferential space relative to said cylinder in a first linear direction to reduce the size of said first chamber and increase the size of said second chamber so as to force the hydraulic fluid to flow from said first chamber to said second chamber at the first flow rate and thus controlling said shaft to rotate at a first rotational speed; and when said shaft is rotated along a second angular direction, opposite to the first angular direction, said plug moves inside said circumferential space relative to said cylinder in a second linear direction, opposite to the first linear direction, to increase the size of said first chamber and reduce the size of said second chamber so as to force the hydraulic fluid to flow from said first chamber to said second chamber at the second flow rate and thus controlling said shaft to rotate at a second rotational speed which is greater than the first rotational speed due to the fact that the second flow rate is greater than the first flow rate.

2. A hydraulic hinge as claimed in claim 1 wherein said securing means by which said plug is linearly movably secured to said shaft comprises a prismatic section formed on said shaft which is substantially snugly received within a hole complementary in shape and size formed in said plug so as to allow said plug to be rotatable in unison with said shaft but linearly movable relative said shaft.

3. A hydraulic hinge as claimed in claim 2 wherein the prismatic section comprises a hexagonal section.

4. A hydraulic hinge as claimed in claim 1 wherein said engaging means by which said plug is engageable with the inside diameter of said cylinder comprises an external thread formed on said plug to be engageable with an inner thread formed on the inside diameter of said cylinder, said external thread having a desired pitch to allow said plug to linearly move relative to said cylinder when rotated by said shaft.

5. A hydraulic hinge as claimed in claim 1 wherein said second fluid passage comprises a channel extending through said shaft to a rear opening thereof which is in fluid communication with said second chamber and a radial passage formed on said shaft to connect said channel to said first chamber and wherein said checking means comprises an expanded section formed on said channel inside which a spring-biased spherical member is disposed to biasingly close the rear opening of said channel so as to allow the hydraulic fluid to flow from the second chamber to said first chamber by pushing said spherical member against the biasing spring to open the rear opening of said channel when said plug is moved along the second linear direction to reduce the size of said second chamber and thus increases pressure of the hydraulic fluid inside said second chamber to a level sufficient to overcome the biasing spring.

6. A hydraulic hinge as claimed in claim 5 wherein said first passage comprises a through hole formed in said spherical member to connect said channel to the rear opening of said channel, said through hole having a cross-sectional dimension smaller than said channel.

7. A hydraulic hinge as claimed in claim 1 further comprising fluid sealing means to provide fluid sealing between said cylinder and said front and rear caps.

8. A hydraulic hinge as claimed in claim 7 wherein said fluid sealing means comprises a rear O-ring disposed within a circumferential groove formed on said plug to be in depressed contact with the inside diameter of said cylinder.

9. A hydraulic hinge as claimed in claim 7 wherein said fluid sealing means comprises a front O-ring and said shaft comprises a disk member having a circumferential groove formed thereon to receive therein the front O-ring, said groove having two opposite sides of which one has a diameter corresponding to the inside diameter of said cylinder and the other has a diameter greater than the inside diameter of said cylinder so as to allow said one of the sides having the smaller diameter and the groove along with the front O-ring snugly received within the inside diameter of said cylinder with said cylinder abutting against said other one of the sides having the greater diameter to have the front O-ring in depressed contact with the inside diameter of said cylinder.

* * * * *